US007481669B1

(12) United States Patent
Lee

(10) Patent No.: US 7,481,669 B1
(45) Date of Patent: Jan. 27, 2009

(54) PLUG-IN WIRING STRUCTURE OF OPTOELECTRONIC DEVICE

(75) Inventor: Fang-Yi Lee, Taipei (TW)

(73) Assignee: TEATEC Fine Ceramics Co., Ltd., Taoyuan County (TW)

( * ) Notice: Subject to any disclaimer, the term of this patent is extended or adjusted under 35 U.S.C. 154(b) by 0 days.

(21) Appl. No.: 11/828,444

(22) Filed: Jul. 26, 2007

(51) Int. Cl.
*H01R 12/24* (2006.01)

(52) U.S. Cl. ..... 439/496; 439/835; 439/67

(58) Field of Classification Search ..... 439/496, 439/67, 835, 863, 816; 114/266; 345/104
See application file for complete search history.

(56) References Cited

U.S. PATENT DOCUMENTS 3,154,365 A * 10/1964 Crimmins ..... 439/496
3,486,159 A * 12/1969 Matthews ..... 439/77
4,684,183 A * 8/1987 Kinoshita et al. ..... 439/77
5,316,486 A * 5/1994 Tanaka et al. ..... 439/62
6,368,147 B1 * 4/2002 Swanson ..... 439/496
6,394,833 B1 * 5/2002 Bulmer et al. ..... 439/393
6,726,504 B2 * 4/2004 Fuerst et al. ..... 439/496
2007/0164980 A1 * 7/2007 Manning ..... 345/104
2007/0234945 A1 * 10/2007 Khouri et al. ..... 114/266

* cited by examiner

*Primary Examiner*—Hien Vu
(74) *Attorney, Agent, or Firm*—Ming Chow; Sinorica, LLC

(57) ABSTRACT

The present invention relates to a plug-in wiring structure of the photovoltaic device, which is applicable to thin-strap connection in electric or electronic apparatuses, such as the output connection of copper-made thin bus straps in a package of solar cell plates. The present invention is characterized in a specialized design that includes a U-shaped clip spring with multiple turnings and a U-shaped terminal so as to have a fixed connection of a thin-strap object. According to the inventive connection, the work procedure of packaging solar cell plates can be simplified and high reliability can be achieved in that it is free from tool for disassembly and can be performed with zero drawing force. The present invention is especially applicable to the package of large-scaled photovoltaic generation cell plates having output through multiple bus straps.

2 Claims, 6 Drawing Sheets

PLUG-IN WIRING STRUCTURE OF OPTOELECTRONIC DEVICE

BACKGROUND OF THE INVENTION

1. Field of the Invention

The present invention relates to a plug-in wiring structure of the photovoltaic device.

2. Descriptions of the Related Art

Since the voltage of a single solar cell is relatively low, in the application of solar photovoltaic generation, multiple cells may be connected in certain combination and then packaged to form a photovoltaic device for use in various severe environmental conditions. Regular photovoltaic components, or solar-cell components, are composed of packaging material, a solar-cell serial (parallel) set and a wiring structure. Photovoltaic devices may be connected serially or parallel in certain combination to form a photovoltaic array and, with other auxiliary control apparatuses, form a solar generation station. From the package of the photovoltaic components, there are multiple copper-made thin bus straps introduced to the wiring structure for connection, for which conventional methods includes welding and sectional press bonding.

The method of welding can be performed only with dedicated tools, such as electric irons, and dedicated materials, such as solder wires. Thus, it involves even unfavorable disassembly and replacement since disassembly can be performed only with an electric iron, so that outdoor assembly and maintenance are very difficult.

The method of sectional press bonding has improvement against that of welding, but it has also the following disadvantages. First, assembly and disassembly can be performed only by using a "_"-shaped screwdriver (of restricted specification).

Second, there are defects in the clip spring for press-connection so that the connection area between the clip spring and the bus strap amounts to the cross-sectional area of the clip material merely and a relatively small contact area is formed there between. Furthermore, this sectional contact in the structure (as having been known in the above description), which can make the bus strap broken under pressure and result in rework of the whole package of devices over the cell plate to retrieve the loss.

In view of those disadvantages derived in the application of the conventional wiring structure as described above, the inventor, having years of relevant experience in development practice, endeavored to design and developed a plug-in wiring structure of the photovoltaic device, which attains a level of economical design.

SUMMARY OF THE INVENTION

The primary objective of this invention is to provide a plug-in wiring structure of the photovoltaic device, which may be embodied without any tool and with zero drawing force, so as to overcome the disadvantages of conventional technologies and achieve simpler assembly and disassembly of the bus straps.

Another objective of this invention is to provide a plug-in wiring structure of the photovoltaic device, which has multiple-point connection in the contact between the bus straps and the wiring terminals, so as to reduce the contact impedance and decrease the power loss.

Yet a further objective of this invention is to provide a plug-in wiring structure of the photovoltaic device, of which the wiring terminals are large-area copper-made terminals, so as to enhance the performance of heat dissipation.

The present invention may be realized through the following scheme. A U-shaped construction with locking points is to be made on a wiring terminal, which is inside the wiring structure, so that a fixed outer frame is provided for a bus strap; and a U-shaped clip spring with multi-turning locking points is to be provided so that the bus strap may be connected finely into the U-shaped construction of the wiring terminal.

The detailed technology and preferred embodiments implemented for the subject invention are described in the following description accompanying the drawings for people skilled in this field to well appreciate the features of the claimed invention.

BRIEF DESCRIPTION OF THE DRAWINGS

The drawings disclose an illustrative embodiment of the present invention which serves to exemplify the various advantages and objects hereof, and are as follows.

DESCRIPTION OF THE PREFERRED EMBODIMENT

For the purpose of further appreciation and realization of the shape, features and functions of the inventive structure, a more preferable embodiment is set forth and described in details accompanying the drawings.

Figure 1A:
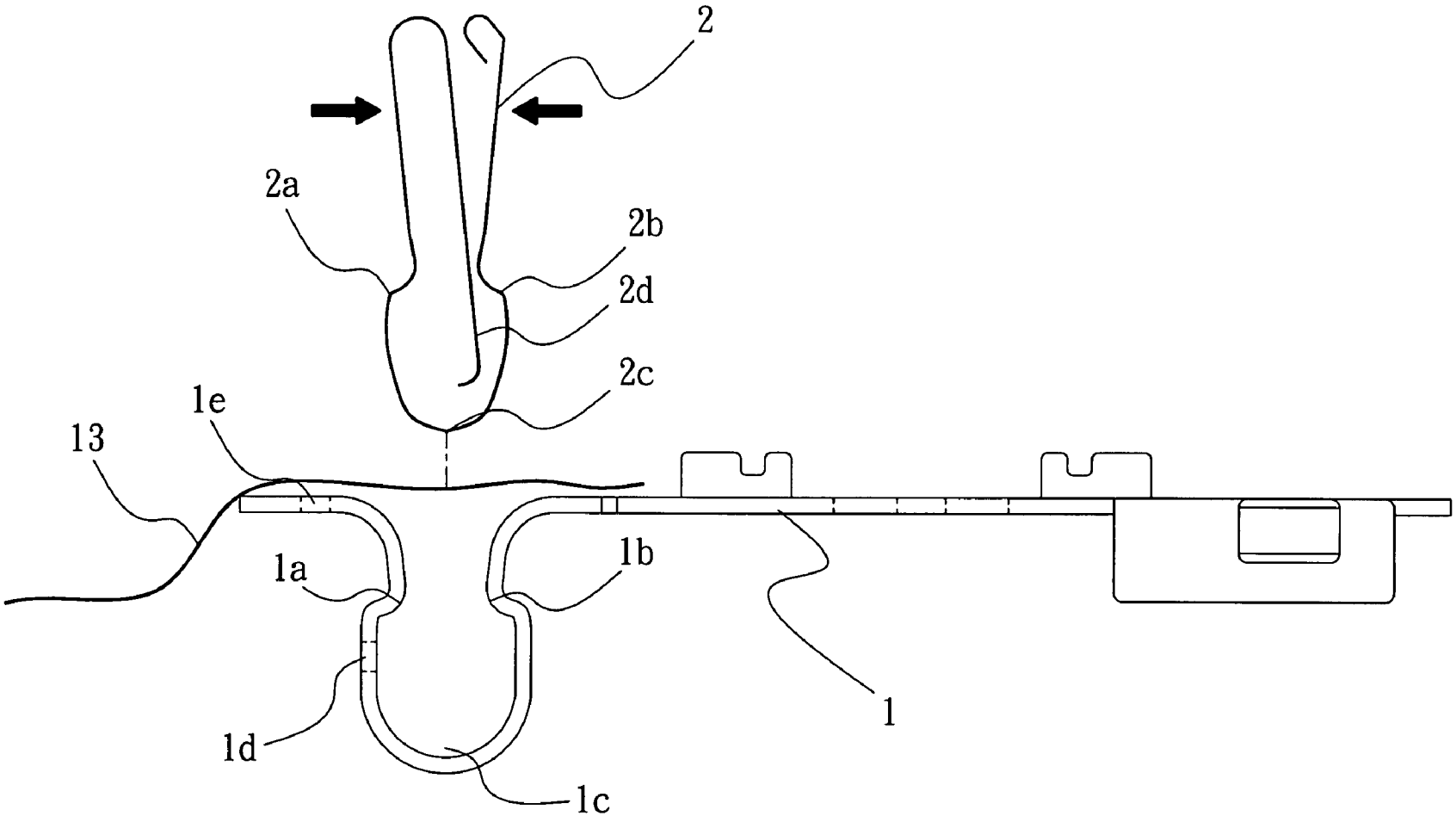
FIG. 1*a* is a first schematic diagram of assembling the structure of the present invention.
Figure 1B:
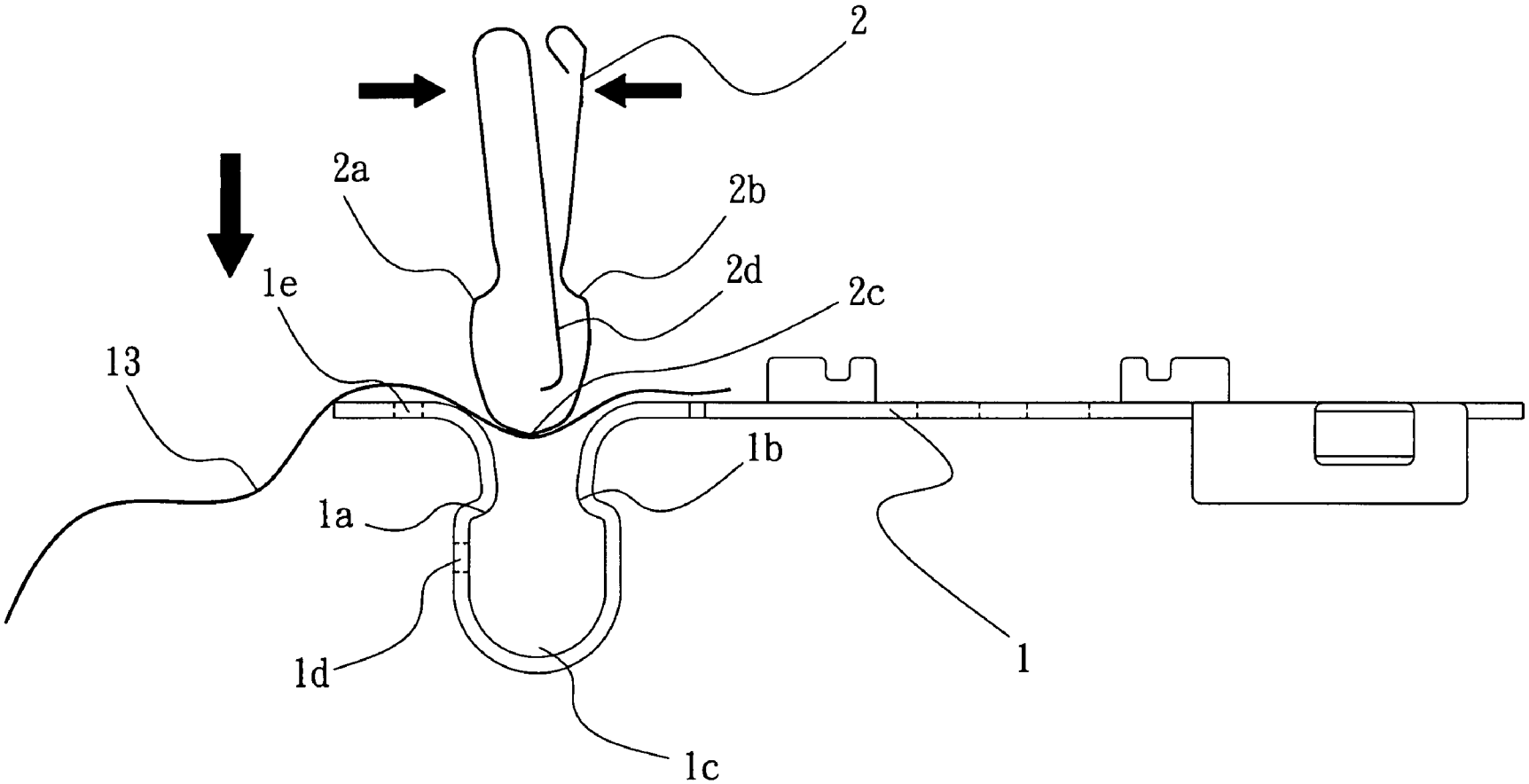
FIG. 1*b* is a second schematic diagram of assembling the structure of the present invention.
Figure 1C:
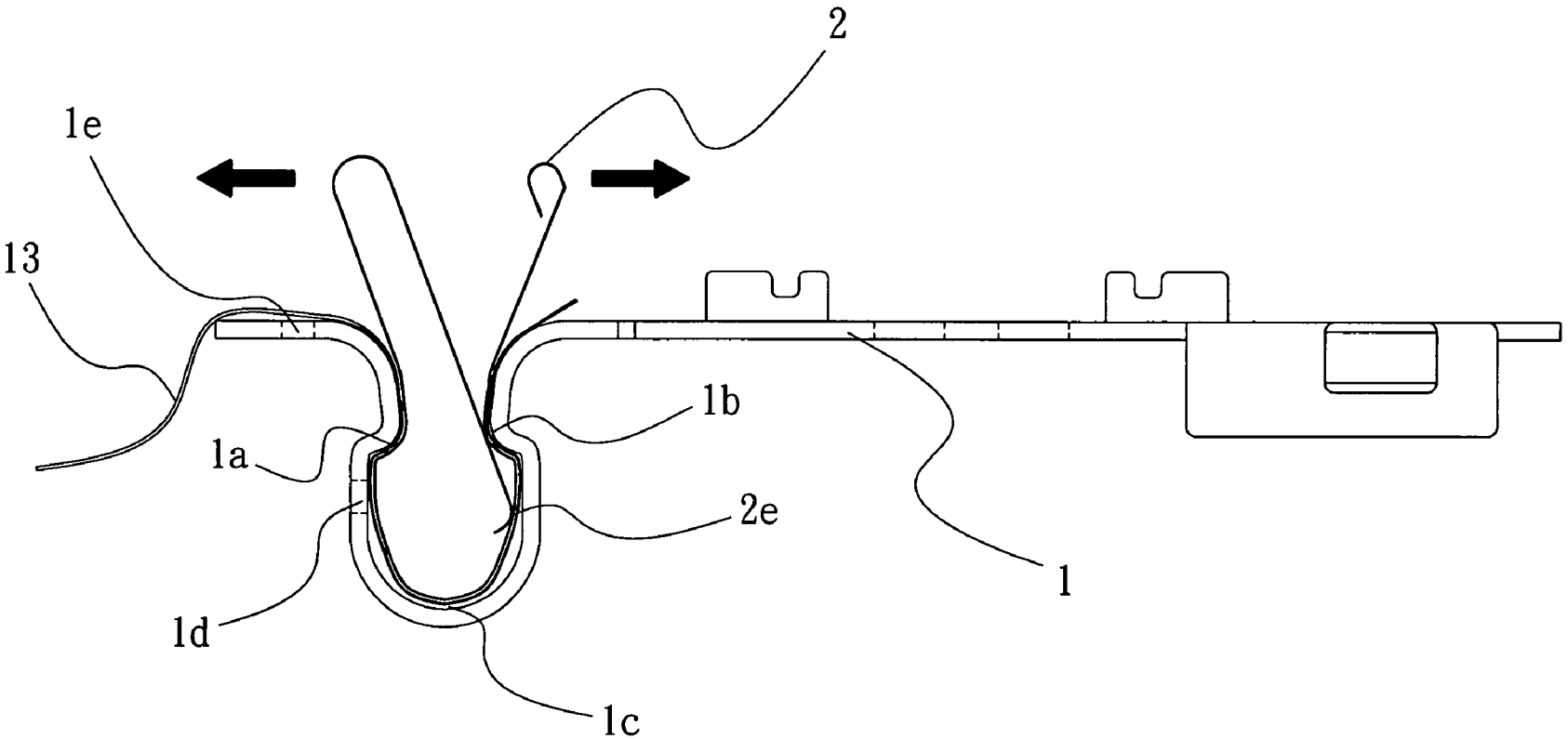
FIG. 1*c* is a third schematic diagram of assembling the structure of the present invention.

Refer to FIG. 1*a*, which shows an embodiment of the plug-in wiring structure of the photovoltaic device. A wiring terminal 1 has a wiring hole 1*e*, through which a bus strap 13 may pass. The bus strap 13 may lie over the wiring terminal 1 as well. The wiring terminal 1 has a locking hole 1*d* for fixing the wiring terminal 1. The wiring terminal 1 has a U-shaped construction disposed at the front end thereof and has two locking points 1*a* and 1*b* and a curved bottom 1*c* disposed in the U-shaped construction, for locking a clip spring thereto. The clip spring is a U-shaped clip spring 2 with locking points. The U-shaped clip spring 2 has locking points 2*a* and 2*b*, a curved bottom 2*c* and a side hook 2*d* extending to tightly contact an opposite side portion 2*e*, so that the U-shaped clip spring 2 can fit the locking points 1*a* and 1*b* and the curved bottom 1*c* of the wiring terminal 1 in an intensive manner, providing a locking for the bus strap 13. Refer to FIG. 1*b*, which shows an embodiment of plugging the clip spring 2 into the U-shaped construction of the wiring terminal 1. It may be performed by pinching with fingers. The clip spring 2 can spring out by means of spring force as the pinch is loosen, and thus fix the bus strap 13 in the U-shaped construction of the wiring terminal 1. Refer to FIG. 1*c*. The bus strap 13 can be fixed on the wiring terminal 1 since the U-shaped clip spring 2 has the locking points 2*a* and 2*b*, the curved bottom 2*c* and the side hook 2*d* extending to tightly contact the opposite side portion 2*e* and, therefore, the U-shaped clip spring 2 fits the locking points 1*a* and 1*b* and the curved bottom 1*c* disposed in the U-shaped construction of the wiring terminal 1 in an intensive manner.

Figure 2A:
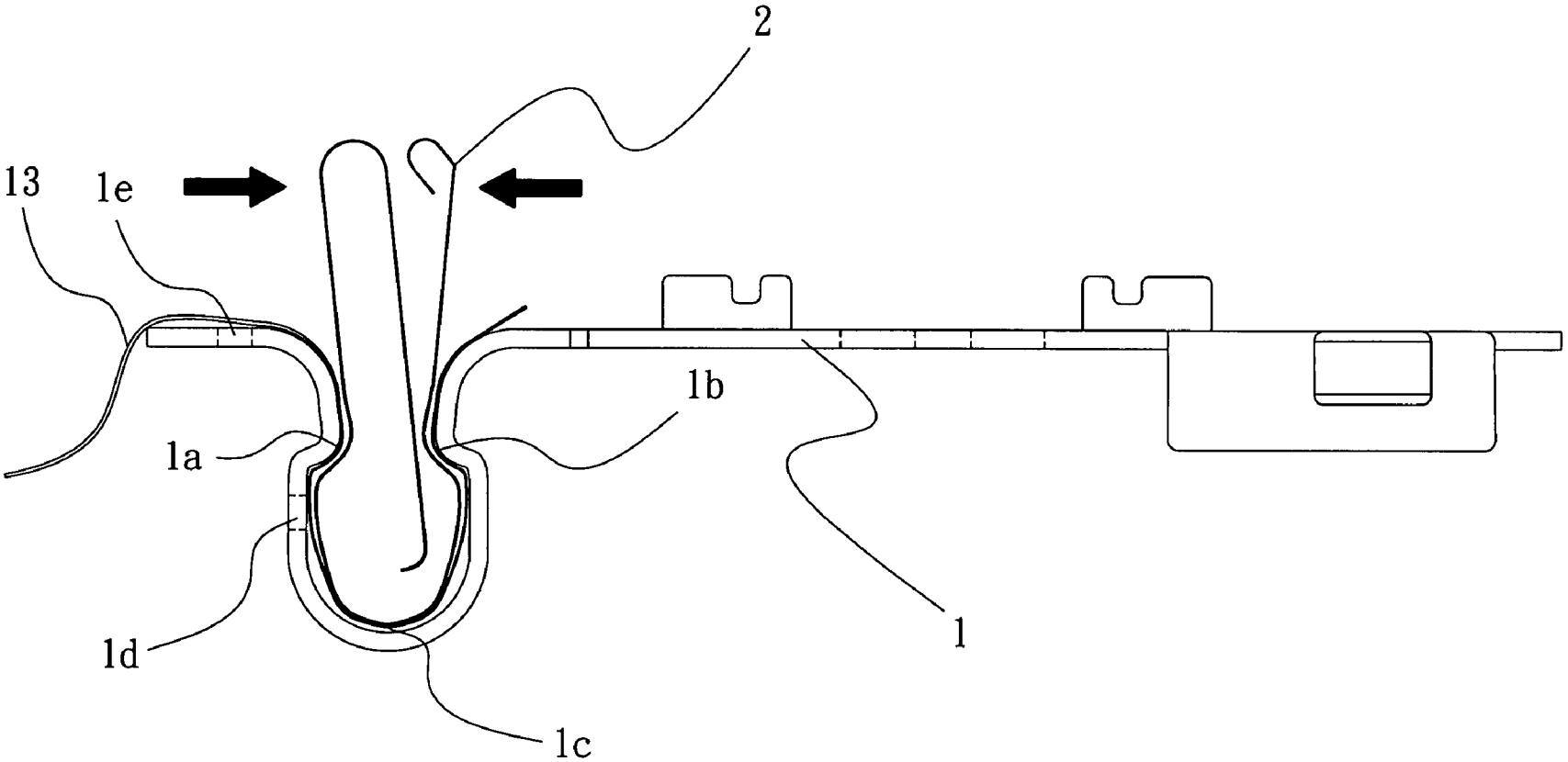
FIG. 2*a* is a first schematic diagram of disassembling the structure of the present invention.
Figure 2B:
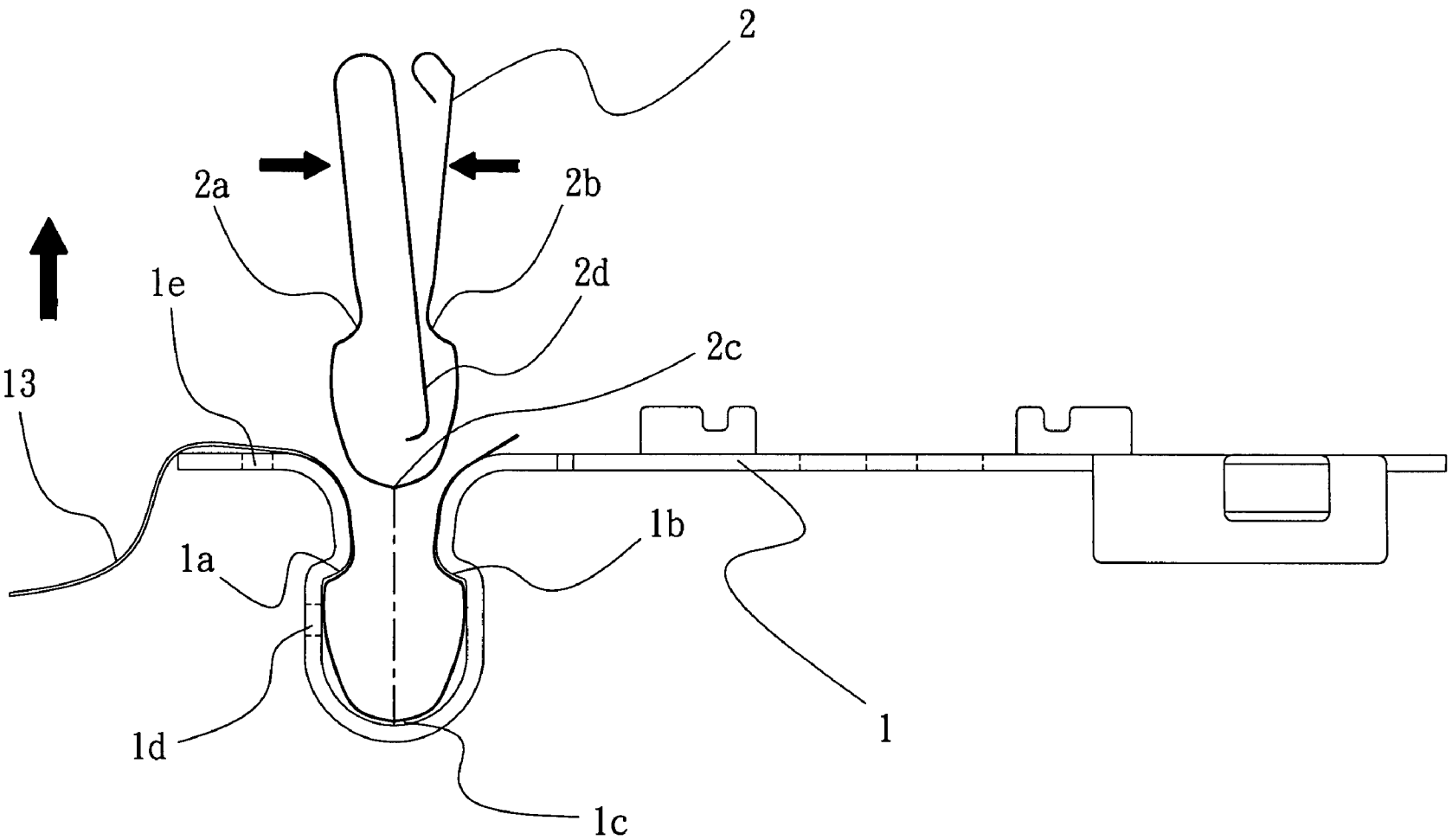
FIG. 2*b* is a second schematic diagram of disassembling the structure of the present invention.
Figure 2C:
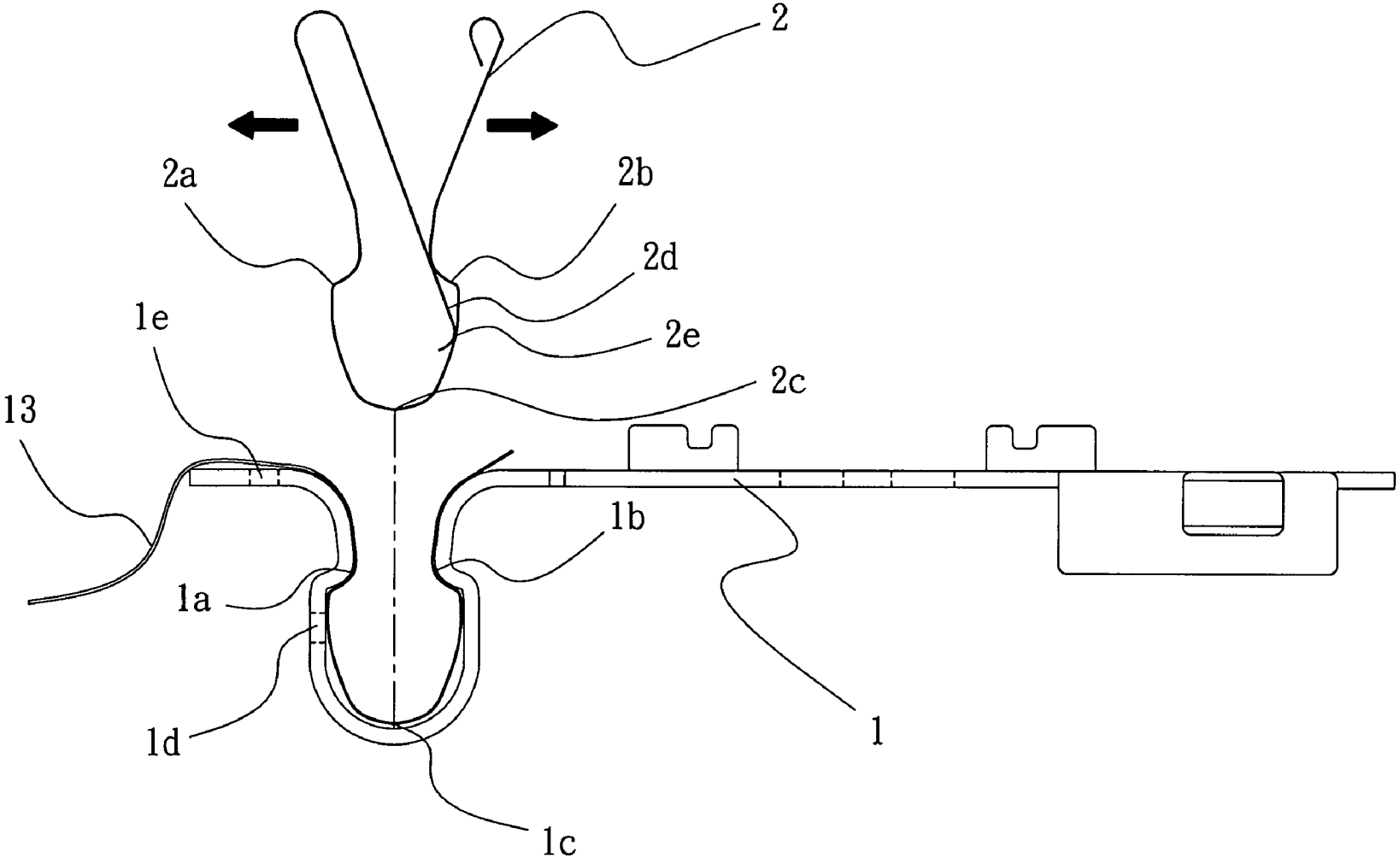
FIG. 2*c* is a third schematic diagram of disassembling the structure of the present invention.

Refer to FIGS. 2*a*-2*c*, which show an embodiment of disassembly. The disconnection between the bus strap 13 and the wiring terminal 1 can be performed by picking the clip spring 2 out upward. It may be performed by pinching with fingers, also. Convenience and reliability of the assembly and the disassembly are promoted, therefore.

The above disclosure is related to the detailed description and drawings for the most preferable embodiment of the present invention. People skilled in this art may perform various changes and modifications in the field of the invention as being covered in the spirit and scope of the appended claims.

Many changes and modifications in the above described embodiment of the invention can, of course, be carried out without departing from the scope thereof. Accordingly, to promote the progress in science and the useful arts, the invention is disclosed and is intended to be limited only by the scope of the appended claims.

What is claimed is:

1. A plug-in wiring structure of a photovoltaic device, comprising a U-shaped clip spring with multi-turning locking points and a U-shaped wiring terminal, wherein said U-shaped clip spring can fix a bus strap so that said bus strap can be pressed downward under the spring force of said U-shaped clip spring, to be connected to said U-shaped wiring terminal of said plug-in wiring structure of said photovoltaic device; and said U-shaped wiring terminal has two locking points and a curved bottom, for locking said U-shaped clip spring with multi-turning locking points thereto, and said U-shaped clip spring has locking points, a curved bottom and a side hook extending to tightly contact an opposite side portion so that said U-shaped clip spring can fit the locking points and the curved bottom of said U-shaped wiring terminal in an intensive manner, providing a locking for said bus strap.

2. The plug-in wiring structure of the photovoltaic device of claim 1, wherein said U-shaped wiring terminal has a wiring hole through which said bus strap can pass so as to be settled on said wiring terminal, and said wiring terminal has a locking hole for fixing said wiring terminal.

* * * * *

UNITED STATES PATENT AND TRADEMARK OFFICE

CERTIFICATE OF CORRECTION

PATENT NO. : 7,481,669 B1
APPLICATION NO. : 11/828444
DATED : July 26, 2007
INVENTOR(S) : Fang-Yi Lee It is certified that error appears in the above-identified patent and that said Letters Patent is hereby corrected as shown below:

Title Pg, Item (73) "Assignee: TEATEC Fine Ceramics Co., Ltd." should read -- Assignee: LEATEC Fine Ceramics Co., Ltd.", Taoyuan County (TW) --

Signed and Sealed this

First Day of December, 2009

David J. Kappos

David J. Kappos
*Director of the United States Patent and Trademark Office*